US010337727B2

(12) United States Patent
Gedcke et al.

(10) Patent No.: US 10,337,727 B2
(45) **Date of Patent: *Jul. 2, 2019**

(54) FURNACE INDUCER CHOKE AND A GAS FURNACE EMPLOYING THE SAME

(71) Applicant: Lennox Industries Inc., Richardson, TX (US)

(72) Inventors: Jeff Gedcke, West Columbia, SC (US); Lawrence Austin, West Columbia, SC (US)

(73) Assignee: Lennox Industries Inc., Richardson, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/133,903

(22) Filed: Sep. 18, 2018

(65) Prior Publication Data

US 2019/0017699 A1 Jan. 17, 2019

Related U.S. Application Data

(63) Continuation of application No. 14/587,491, filed on Dec. 31, 2014, now Pat. No. 10,082,287.

(51) Int. Cl.

| | |
|---|---|
| ***F24D 5/00*** | (2006.01) |
| ***F23C 7/00*** | (2006.01) |
| ***F23L 13/02*** | (2006.01) |
| ***F23L 17/00*** | (2006.01) |
| ***F24H 3/08*** | (2006.01) |

(52) U.S. Cl.

CPC ..... *F23C 7/008* (2013.01); *F23L 13/02* (2013.01); *F23L 17/005* (2013.01); *F24D 5/00* (2013.01); *F24H 3/087* (2013.01); *F23C 2200/00* (2013.01)

(58) Field of Classification Search

CPC ..... F23L 17/00; F23L 17/005; F23N 1/025; F23N 3/04

USPC ..... 110/162; 126/116 B; 431/12

See application file for complete search history.

(56) References Cited

U.S. PATENT DOCUMENTS

| | | | | |
|---|---|---|---|---|
| 3,280,774 | A | 10/1966 | English | |
| 4,913,041 | A | 4/1990 | Taber et al. | |
| 5,992,410 | A | 11/1999 | Raleigh et al. | |
| 10,082,287 | B2 * | 9/2018 | Gedcke | F23C 7/008 |
| 2009/0326480 | A1 | 12/2009 | Milijasevic | |

* cited by examiner

*Primary Examiner* — Vivek K Shirsat

(74) *Attorney, Agent, or Firm* — Winstead PC

(57) ABSTRACT

A furnace inducer choke and a gas furnace employing the furnace inducer choke. In one embodiment, the furnace inducer choke includes: (1) a choke body configured to engage a furnace inducer blower, the choke body having an opening extending entirely therethrough to limit an amount of combustion air entering a furnace that the furnace inducer blower is attached, and (2) a tab protruding from the choke body a distance sufficient to identify the opening when the choke body and furnace inducer blower are installed in the furnace.

19 Claims, 3 Drawing Sheets

FURNACE INDUCER CHOKE AND A GAS FURNACE EMPLOYING THE SAME

CROSS-REFERENCED APPLICATIONS

Figure 1:
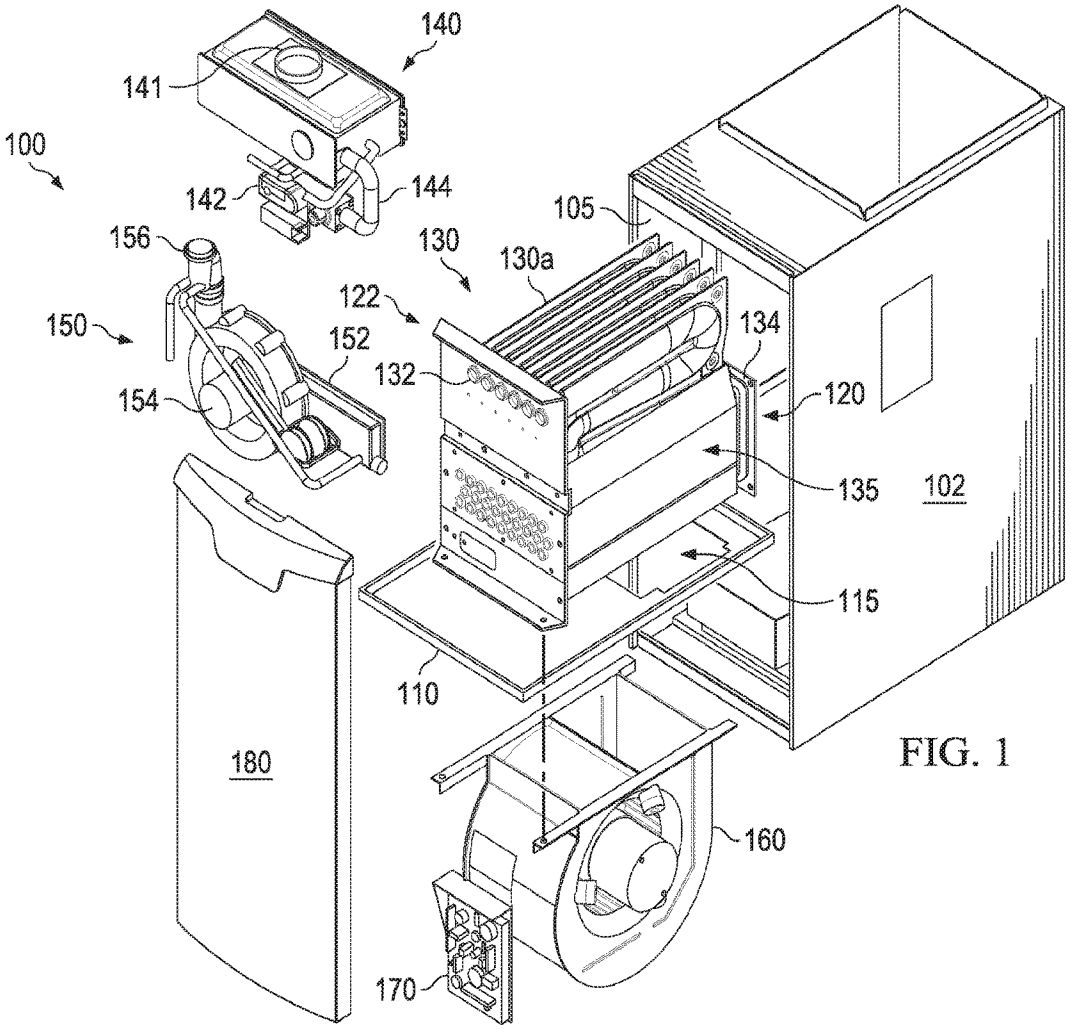

This application is a continuation of U.S. patent application Ser. No. 14/587,491, filed on Dec. 31, 2014. U.S. patent application Ser. No. 14/587,491 is incorporated herein by reference.

TECHNICAL FIELD

This application is directed, in general, to a furnace inducer choke and, more specifically, furnace inducer choke having an identification tab.

BACKGROUND

In induced draft furnaces, a motor driven inducer blower may be provided to enhance the mixing of combustion air with the fuel in order to better facilitate the combustion process. While the inducer blower may be located upstream and be of the blow-through type, it is more common to place it downstream of the combustion process so as to draw the supply air into the burner and cause the combustion gases to flow through the heat exchangers and the vent pipe to be discharged outside.

Induced draft furnaces may employ a furnace inducer choke to help control the amount of combustion air entering the induced draft furnace. As a given size inducer blower may be used for a variety of different sized induced draft furnaces (e.g., to simplify the manufacturing process) the inducer chokes tend to be removable and interchangeable. Unfortunately, the location and positioning of the inducer blower, and more specifically, inducer choke when installed in the inducer blower, make it difficult to determine what size choke is being used for a given installation.

SUMMARY

One aspect provides a furnace inducer choke. In one embodiment, the furnace inducer choke includes: (1) a choke body configured to engage a furnace inducer blower, the choke body having an opening extending entirely therethrough to limit an amount of combustion air entering a furnace that the furnace inducer blower is attached, and (2) a tab protruding from the choke body a distance sufficient to identify the opening when the choke body and furnace inducer blower are installed in the furnace.

Another aspect provides a gas furnace. In one embodiment, the gas furnace includes: (1) a housing, (2) a heat exchanger located within the housing that includes one or more spaced apart primary heating chambers, (3) a furnace inducer blower located within the housing and coupled to the heat exchanger, the furnace inducer blower configured to enhance a mixing of combustion air with fuel in order to better facilitate a combustion process within the heat exchanger, (4) a furnace inducer choke coupled to the furnace inducer blower, including: (4*a*) a choke body configured to engage the furnace inducer blower, the choke body having an opening extending entirely therethrough to limit an amount of the combustion air entering the heat exchanger, (4b) a tab protruding from the choke body a distance sufficient to identify the opening when the choke body and furnace inducer blower are coupled to the heat exchanger, and (5) a blower located within the housing, the blower configured to force air across the heat exchanger for heating thereof.

Yet another aspect provides an alternative furnace inducer choke. The alternative furnace inducer choke, in one embodiment, includes: (1) a choke body configured to engage a furnace inducer blower, the choke body having an opening extending entirely therethrough to limit an amount of combustion air entering a furnace that the furnace inducer blower is attached, (2) a tab protruding from the choke body, and (3) a mounting feature attached proximate an end of the tab, the mounting feature configured to position the furnace inducer blower during installation in the furnace.

BRIEF DESCRIPTION

Figure 2A:
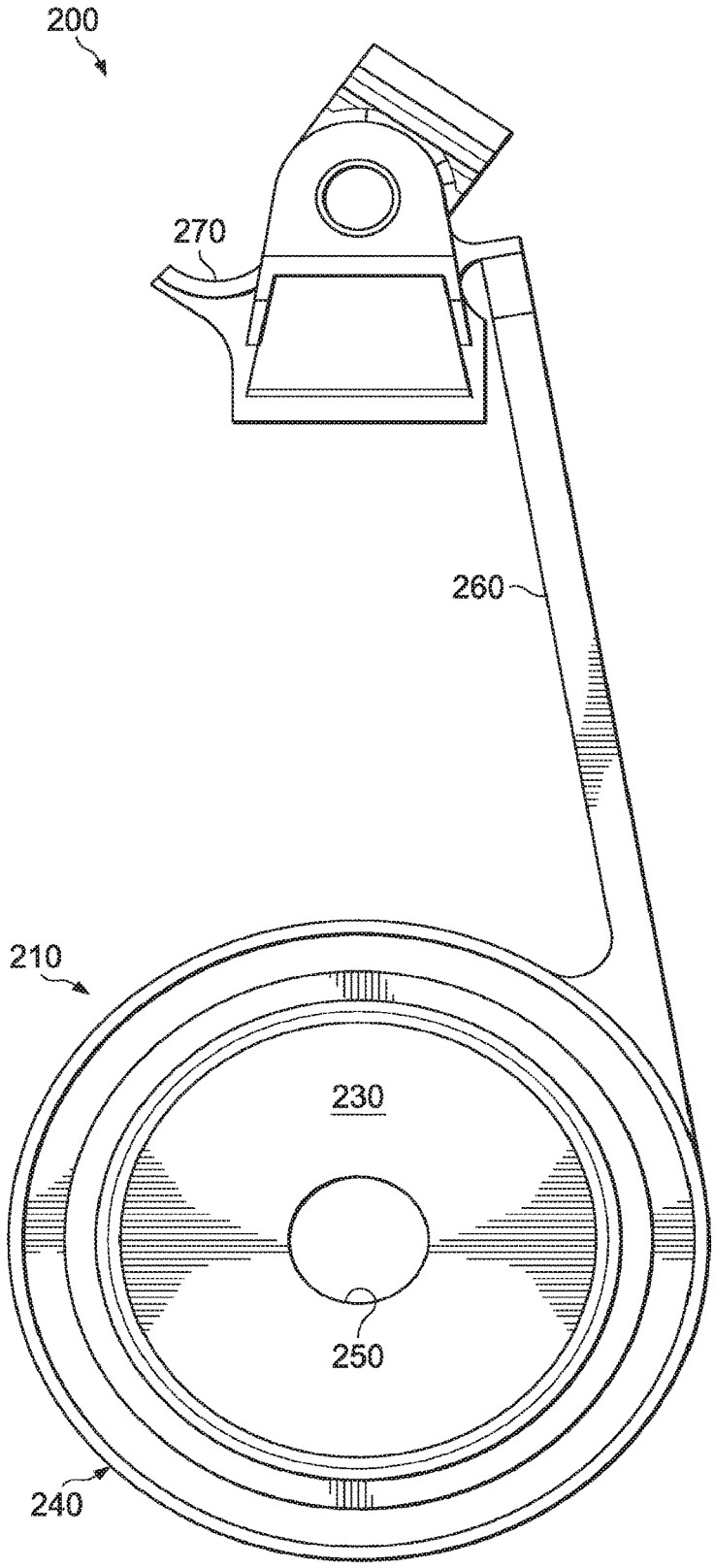
Figure 2B:
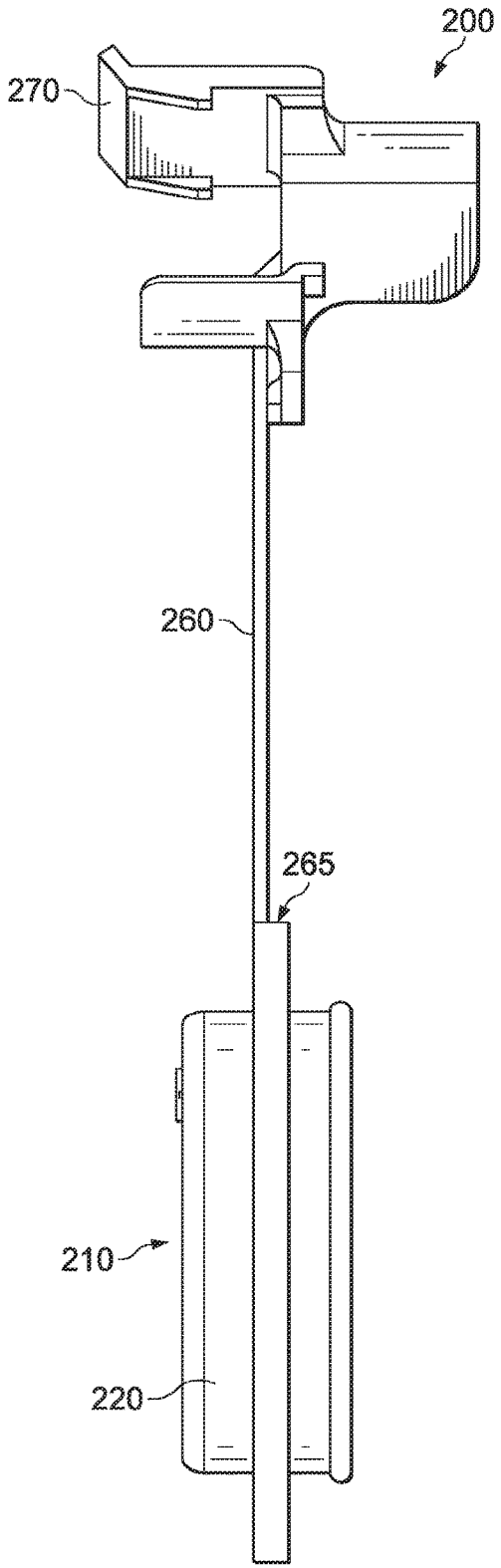

Reference is now made to the following descriptions taken in conjunction with the accompanying drawings, in which:

FIG. 1 is an exploded isometric view of a portion of one embodiment of a furnace (e.g., high-efficiency furnace) within which embodiments of the furnace inducer choke as presented herein may be employed; and FIGS. 2A and 2B illustrate various different views of a furnace inducer choke manufactured in accordance with the disclosure.

DETAILED DESCRIPTION

FIG. 1 is an exploded isometric view of a portion of one embodiment of a gas furnace 100 (e.g., high-efficiency furnace) within which embodiments of a furnace inducer choke as presented herein may be employed. In the illustrated embodiment, the gas furnace 100 includes a housing 102 having a front opening 105 within which a mounting shelf 110 may be located. The mounting shelf 110, in the illustrated embodiment, has an opening 115 therein and supports a heat exchanger assembly 120 over the opening 115.

In the illustrated embodiment, the heat exchanger assembly 120 has a primary heating zone 130 that includes a row of six heating chambers (on referenced as 130*a*) coupled to an inlet panel 122. Alternative embodiments of the heat exchanger assembly 120 have more or fewer heating chambers 130*a* coupled to the inlet panel 122 in one or more rows. In the illustrated embodiment, the heating chambers 130*a* are generally serpentine and have two approximately 180° folds such that the heating chambers 130*a* cross over the opening 115 three times. In the illustrated embodiment, the heating chambers 130*a* terminate in inlets 132 and outlets 134 that are generally mutually coplanar and oriented toward the opening 105 of the housing 100. The heat exchanger assembly 120 may further include a secondary heat exchanger zone 135 that is a heat exchanger/condenser.

The gas furnace 100 of the embodiment of FIG. 1 further includes a burner assembly 140. In the illustrated embodiment, the burner assembly 140 contains a combustion air intake 141, a valve 142 (e.g., thermostatically-controlled solenoid valve), a manifold 144 leading from the valve 142 and across the burner assembly 140, one or more gas orifices (not shown) coupled to the manifold and one or more burners (not shown) corresponding to and located proximate the gas orifices. In the illustrated embodiment, the burner assembly 140 has a row of six burners. Alternative embodiments of the burner assembly 140 have more or fewer burners arranged in one or more rows, for example depending on the number of heating chambers 130*a*. In an assembled configuration, the burner assembly 140 is located proximate the heat exchanger assembly 120 such that the burners thereof at least approximately align with the inlets 132.

The gas furnace 100 of the embodiment of FIG. 1 further includes a furnace inducer blower 150. The furnace inducer blower 150, in this embodiment, contains a manifold 152, a draft inducing exhaust fan 154 having an inlet coupled to the manifold 152 and a flue 156 coupled to an outlet of the exhaust fan 154. In one embodiment of an assembled configuration, the furnace inducer blower 150 is located proximate the heat exchanger assembly 120, such that the manifold 152 thereof at least approximately aligns with the outlets 134.

In the illustrated embodiment, a furnace inducer choke (not shown in FIG. 1) in accordance with the present disclosure is coupled to the furnace inducer blower 150. For example, the furnace induce choke may couple to any portion of the furnace inducer blower 150, including the draft inducing exhaust fan 154, or a housing thereof, the manifold 152, or a housing thereof, and the flue 156, among other locations of the furnace inducer blower 150. While more details will be shown and discussed below with regard to FIG. 2, the furnace inducer choke is typically configured to limit an amount of combustion air entering the heat exchanger assembly 120. The term "limit" as used herein, is in relation to a scenario whereby the furnace inducer blower 150 does not have the furnace inducer choke, wherein a greater amount of combustion air would enter the heat exchanger assembly 150. The furnace inducer choke, in addition to limiting an amount of combustion air entering the heat exchanger assembly 120, may also be deemed to tailor the amount of combustion air entering the heat exchanger assembly (e.g., based upon a size of the gas furnace 100 features).

In the embodiment of FIG. 1, a blower 160 is located within the housing 102. In this embodiment, the blower 160 is suspended from the shelf 110 such that an outlet (not referenced) thereof approximately aligns with the opening 115. In the embodiment of FIG. 1, an electronic controller 170 is located proximate the blower 160, and controls the blower 160, thermostatically-controlled solenoid valve 142 and the exhaust fan 154 to cause the gas furnace 100 to provide heat. A cover 180 may be placed over the front opening 105 of the housing 100.

In the illustrated embodiment, the controller 170 turns on the exhaust fan 154 to initiate a draft in the heat exchangers (including the primary heating zone 130), enhance a mixing of combustion air with fuel in order to better facilitate a combustion process, and purge potentially harmful unburned gases or gaseous combustion products. Then the controller 170 opens the valve 142 to admit fuel to the manifold 144 and the one or more gas orifices, whereupon the fuel begins to mix with air to form primary combustion air. Then the controller 170 activates an igniter (not shown in FIG. 1) to attempt to ignite the primary combustion air. If the output of a sensor (e.g., thermocouple, flame rod, etc.) indicates that the primary combustion air has not ignited within a predetermined period of time, the controller 170 then closes the valve 142 and waits until attempting to start again. If the output of a thermocouple indicates that the primary combustion air has ignited within the predetermined period of time, the controller 170 then activates the blower 160, which forces air upward through the opening 115 and the heat exchanger assembly 120. As the air passes over the surfaces of the heat exchangers, the air is warmed, whereupon it may be delivered or distributed as needed to provide heating.

Turning now to FIGS. 2A and 2B, illustrated are various different views of a furnace inducer choke 200 manufactured in accordance with the disclosure. The furnace inducer choke 200, in certain instances, may be similar to the furnace inducer choke briefly discussed above with regard to FIG. 1. In other instances, the furnace inducer choke 200 might have different features from the furnace inducer choke briefly discussed above.

The furnace inducer choke 200 of FIGS. 2A and 2B initially includes a choke body 210. The choke body 210, in this embodiment, is that portion of the furnace inducer choke 200 that would otherwise engage a furnace inducer blower (e.g., similar to the furnace inducer blower 150 discussed above with regard to FIG. 1). For example, the choke body 210 might engage a housing of the furnace inducer blower. In one specific embodiment, a rear lip portion 220 of the choke body 210 might slidably engage within a similarly shaped opening in the housing of the furnace inducer blower, thereby mating the two features from a fluid perspective. In another specific embodiment, the choke body 210 might attach to a face of the housing of the furnace inducer blower (e.g., using one or more fasteners). Notwithstanding the foregoing example embodiments, any known or hereafter discovered technique might be used to couple the choke body 210 to the furnace inducer blower.

In the illustrated embodiment of FIGS. 2A and 2B, the choke body 210 includes a major surface 230 (e.g., as shown in FIG. 2A). In this illustrated embodiment, the major surface 230 defines a perimeter 240 of the choke body 210. For instance, in the embodiment of FIGS. 2A and 2B, the perimeter 240 is a circle. As one example, in the embodiment of FIGS. 2A and 2B, the choke body 210 might have a diameter ranging from about 3 cm to about 8 cm. In an alternative embodiment, the perimeter might be a triangle, quadrilateral, or any other usable shape adaptable to the furnace inducer blower, and the dimensions might relate accordingly.

Extending entirely through the choke body 210 in the embodiment of FIGS. 2A and 2B is an opening 250. The opening 250, as those skilled in the art appreciate, is configured to limit an amount of combustion air entering the furnace that the furnace inducer blower is attached. While the opening 250 illustrated in FIGS. 2A and 2B is circular in nature, any known or hereafter shape may be used for a given installation, so long as the size of the opening 250 is the same. For example, the choke body 210, or the gas furnace it is attached to, would not likely notice a difference between a circular opening, a square opening or a hexagon opening for a given installation, so long as they have the same minimum cross-sectional area (e.g., 1 $cm^2$). As those skilled in the art appreciate, the size of the opening is designed (e.g., tailored) for a particular gas furnace and/or furnace inducer blower.

The furnace inducer choke 200 of the embodiment of FIGS. 2A and 2B further includes a tab 260 protruding from the choke body 210. The tab 260, or at least a distance it protrudes from the choke body 210, is chosen such that it can identify the opening 250 when the choke body 210 and furnace inducer body are installed in a gas furnace. Given the position and location of the furnace inducer choke 200, particularly as it relates to the furnace inducer blower and other features of the gas furnace, the distance the tab 260 protrudes from the choke body 210 may vary. In one known example, the distance is at least about 3 cm. In certain embodiments, for example where the other features of the gas furnace are larger, or the features are cramped, the distance may need to be at least about 5 cm, or even better yet at least about 9 cm.

In certain embodiments of the disclosure, the tab 260 extends primarily in a direction substantially parallel to the major surface 230 of the choke body 210. For example, the tab 260 might have a small portion that is not parallel to the major surface 230 of the choke body 210 (e.g., a small jaunt at an angle), but the majority of the tab 260 extends in a direction substantially parallel to the major surface 230 of the choke body 210. In yet another embodiment, such as illustrated in FIGS. 2A and 2B, the tab 260 extends from an edge 265 of the choke body 210 in a direction substantially parallel to the major surface 230 of the choke body 210.

The tab 260, in accordance with one embodiment, may include one or more identifiers as to one or more features of the choke body 210. For instance, the tab 260 might include one or more identifiers as to one or more features of the opening 250. The one or more features of the opening 250 identified by the tab 260 might include, without limitation, size of the opening 250, shape of the opening 250, location of the opening 250, among others.

A variety of different mechanism might be employed on or with the tab 260 to identify the one or more features of the choke body 210. For example, in one embodiment the tab 260 might be color-coded to identify the one or more features of the choke body 210. In one embodiment, the tab 260 might be color-coded to identify a size or shape of the opening 250. In another embodiment, a given shape of the tab 260 might identify the one or more features of the choke body 210. For example, a given shape of the tab 260 might identify a size or shape of the opening 250. In yet another embodiment, the tab 260 might include a label to identify the one or more features of the choke body 210. For example, the label might be used to identify a size or shape of the opening 250, among many other features.

Attached to the tab 260, in the embodiment of FIGS. 2A and 2B, is a mounting feature 270. The mounting feature 270 illustrated in FIGS. 2A and 2B, in accordance with the disclosure, is attached proximate an end of the tab 260. In this embodiment, the mounting feature 270 would be configured to position the furnace inducer blower during installation in the gas furnace, particularly in difficult installations where space is limited or the item being installed is cumbersome. In one particular embodiment, the mounting feature 270 is configured to attach to a feature of the furnace inducer blower manifold (e.g., manifold 152 of FIG. 1), and thus assist in coupling the draft inducing exhaust fan to the manifold.

The mounting feature 270 might embody a variety of different designs and remain within the purview of the disclosure. For instance, in one embodiment the mounting feature 270 is a clip specifically designed and located to engage another known (e.g., by location and/or shape) feature of the gas furnace. In another instance, the mounting feature 270 is a footing or projection specifically designed and located to engage another known (e.g., by location and/or shape) feature of the gas furnace. The mounting feature 270 could additionally be appropriately placed Velcro™, an appropriately placed suction cup, or any other known or hereafter discovered mounting feature 270 consistent with the present disclosure.

Those skilled in the art to which this application relates will appreciate that other and further additions, deletions, substitutions and modifications may be made to the described embodiments.

The invention claimed is:

1. A furnace inducer choke, comprising:

a choke body having a major surface, wherein the choke body is configured to engage a furnace inducer blower;

a tab extending from the choke body at an acute angle, wherein the tab comprises a base end and an attachment end and extends in a direction parallel to the major surface, wherein the base end is connected substantially perpendicular to an edge of a perimeter of the major surface while also being substantially parallel to the major surface of the choke body; and a mounting feature connected to the attachment end of the tab, the mounting feature being spaced away from the choke body.

2. The furnace inducer choke of claim 1, wherein the tab protrudes from the choke body at a distance sufficient to identify an opening when the choke body and furnace inducer blower are installed in a gas furnace, thereby enabling the mounting feature to properly position the furnace inducer blower during installation in the gas furnace.

3. The furnace inducer choke of claim 1, wherein the choke body comprises an opening extending entirely therethrough to limit an amount of combustion air entering a gas furnace to which the furnace inducer blower is attached.

4. The furnace inducer choke of claim 1, wherein the major surface defines a perimeter surface.

5. The furnace inducer choke of claim 4, wherein the perimeter surface comprises a circle.

6. The furnace inducer choke of claim 3, wherein the tab is color-coded to identify a size of the opening.

7. The furnace inducer choke of claim 3, wherein the tab includes a label to identify a size of the opening.

8. The furnace inducer choke of claim 2, wherein the mounting feature comprises a clip configured to engage the gas furnace during installation.

9. A gas furnace, comprising:

a housing;

a heat exchanger assembly positioned within the housing;

a furnace inducer blower positioned within the housing and coupled to the heat exchanger assembly;

a furnace inducer choke coupled to the furnace inducer blower, comprising:

a choke body having a major surface, wherein the choke body is configured to engage a furnace inducer blower;

a tab extending from the choke body at an acute angle, wherein the tab comprises a base end and an attachment end and extends in a direction parallel to the major surface, wherein the base end is connected substantially perpendicular to an edge of a perimeter of the major surface while also being substantially parallel to the major surface of the choke body; and a mounting feature connected to the attachment end of the tab, the mounting feature being spaced away from the choke body.

10. The gas furnace of claim 9, wherein the heat exchanger comprises at least one spaced apart primary heating chamber.

11. The gas furnace of claim 9, wherein the furnace inducer blower is configured to enhance a mixing of combustion air with fuel in order to better facilitate a combustion process within the heat exchanger assembly.

12. The gas furnace of claim 9, wherein the major surface defines a perimeter surface, and further wherein the tab extends in a direction parallel to the major surface.

13. The gas furnace of claim 12, wherein the perimeter surface comprises a circle.

14. The gas furnace of claim 9, wherein the tab is color-coded to identify a size of an opening.

15. The gas furnace of claim 9, comprising a blower located within the housing, the blower configured to force air across the heat exchanger assembly for heating thereof.

16. The gas furnace of claim 9, wherein the tab protrudes from the choke body at a distance sufficient to identify an opening when the choke body and furnace inducer blower are installed in a gas furnace, thereby enabling the mounting feature to properly position the furnace inducer blower during installation in the gas furnace.

17. The gas furnace of claim 9, wherein the choke body comprises an opening extending entirely therethrough to limit an amount of combustion air entering a gas furnace to which the furnace inducer blower is attached.

18. The gas furnace of claim 9, wherein the mounting feature is a clip configured to engage the gas furnace during the installation.

19. A furnace inducer choke, comprising:

a choke body having a major surface, wherein the choke body is configured to engage a furnace inducer blower;

a tab extending from the choke body at an acute angle, wherein the tab comprises a base end and an attachment end and extends in a direction parallel to the major surface, wherein the base end is connected substantially perpendicular to an edge of a perimeter of the major surface; and a clip connected to the attachment end of the tab and is spaced away from the choke body.

* * * * *